US005207127A

United States Patent [19]

Nick

[11] Patent Number: 5,207,127

[45] Date of Patent: May 4, 1993

[54] FASTENER SUPPORT APPARATUS

[76] Inventor: Edward V. Nick, 512 Lexington Ave., Fox River Grove, Ill. 60021

[21] Appl. No.: 814,758

[22] Filed: Dec. 30, 1991

[51] Int. Cl.[5] ..... B25B 13/00

[52] U.S. Cl. ..... 81/54; 81/57.37; 81/429; 81/451

[58] Field of Search ..... 81/54, 55, 57.23, 57.37, 81/429, 431, 451

[56] References Cited

U.S. PATENT DOCUMENTS 2,310,287 2/1943 Hausbeck .
2,633,169 3/1953 Siems .
2,774,401 12/1956 Hallam .
2,884,971 5/1959 Dierker .
3,757,407 9/1973 Bomar .
4,058,884 11/1977 Lydon et al. ..... 81/451 X
4,140,161 2/1979 Russo ..... 81/451
4,653,358 3/1987 Lankry ..... 81/429 X
4,936,169 6/1990 Parsons .

*Primary Examiner*—James G. Smith
*Attorney, Agent, or Firm*—Godfrey & Kahn

[57] ABSTRACT

A fastener support apparatus for facilitating the installation of individual screws into a work surface including means for driving individual screws into the work surface; a support member borne on the driving means; a screw support assembly borne on the support member and defining a screw receiving station which is operable to receive the head of the screw; a locking assembly borne on the screw support assembly and operable for travel from a first, partially occluding position relative to the screw receiving station to a second, substantially nonoccluding position; and an actuating assembly borne on the screw support assembly and which positions the locking assembly in the first or second positions.

16 Claims, 6 Drawing Sheets

FASTENER SUPPORT APPARATUS

1. FIELD OF THE INVENTION

The present invention relates generally to an apparatus for facilitating the installation of individual fasteners, such as screws or the like, and more particularly, to an apparatus which is operable to releasably secure the head of an individual screw in a predetermined location relative to a rotatable bit thereby facilitating the installation of the screw into a work piece, and which further is operable to release the head of the screw from the predetermined location upon the engagement of the apparatus with the work piece.

2. DESCRIPTION OF THE PRIOR ART

During the construction of buildings, and in the manufacture of various articles of commerce, it is typically necessary for a worker to install numerous screws or other types of threaded fasteners into assorted work pieces by employing powered screw driving tools having various configurations and designs. In the construction of dwellings, for example, work pieces which may be joined to other objects or surfaces by threaded fasteners may include sheet-like materials such as drywall, decorative paneling, plywood subflooring and the like. These materials, of course, have different textures and also may be positioned in assorted locations and positions which may from time to time present problems with regards to installing a screw type fastener in the respective surfaces. For example, the tough texture of sheet-like materials, such as exterior-grade plywood may present difficulties in starting the threaded fastener or further, the screw may need to be driven in a non-perpendicular or angled relationship through the work piece. Moreover, and during the installation of screws or other fasteners which have a substantial length dimension, the slotted portion of the screw head will often become distorted or burred by the rotatable bit of the powered screw driver when the bit temporarily disengages from the screw head. When this event occurs, installation or removal of the screw often becomes difficult. Moreover, the aesthetic appearance of the object may be adversely affected. To prevent or otherwise inhibit this distortion or burring of a screw head, or further, to insure that the screw is being started in an appropriate fashion in the work piece, which is not provided with a pilot hole, it is often necessary to apply substantial physical force to the powered screwdriver thereby fixedly positioning the screw in tight engagement with the rotatable bit. Further, and if the screw is being installed in material which is rather tough, such as in pressure treated lumber, this physical force will need to be maintained until the screw is installed completely into the material.

Heretofore, various devices and assemblies have been constructed and incorporated into both manual and powered screw driving tools and which hold individual screws during the screw installation process. These prior art screw holding devices have generally included two categories of mechanical design. In the first design category, these prior art screw holding devices have included a powered screw driving means and a detachably mounted device for holding a plurality of screws in a ready, screw driving position. In the second design category, these prior art screw holding devices have typically included a manually operated screw driving means and which has made integral therewith, an attachment for holding individual screws.

Examples of prior art devices which include the aforementioned screw holding devices are found in U.S. Pat. Nos. 3,757,407; 4,936,169; 2,884,971; 2,774,401; 2,310,287; and 2,633,169.

Foremost among the noted deficiencies of some of these prior art screw holding devices is their apparent inability to securely hold a screw, during the installation thereof or to automatically release the screw when the screw holding device engages a work surface. More particularly, the prior art screw holding devices of the first design category automatically release an individual screw from the device prior to the complete installation of the screw. Further, the screw holding devices of the second design category typically require that a user manually disengage the individual screw from the device, such as by actuating a lever or the like. As should be understood, the prior art screw holding devices of the first design category do not hold the heads of the respective individual screws in a locked position against the rotatable bit throughout the entire screw installation cycle. Therefore, the individual screw heads may become distorted or burred during installation, unless, the user applies substantial force to the device to insure a tight, interlocking relationship between the bit and the screw head. Of course, utilizing a tool under these conditions for a prolonged period of time will eventually result in worker fatigue.

Another deficiency of the prior art screw holding devices of the second design category, as noted earlier, is that the user must manually disengage or release the screw from the device. For example, in U.S. Pat. No. 2,774,401, a screw driver is disclosed which includes a screw holding device and a screw head pressure applicator. The device is operable, by way of a pivoted lever, to cause the bit to tightly engage the screw head. In operation, a user must manually move the lever back and forth from a first, screw release position, wherein the screw head pressure applicator is disposed in a non-engaging position, which permits a screw to be loaded in the screw holding device, to a second, screw engaging position, and wherein the bit tightly engages the screw. This type of a device, of course, increases the total number of steps required to install a single screw, and which, when multiplied by hundreds of screws, reduces the efficiency of any manufacturing process employing same. Other prior art screw holding devices of the second design type generally require that assorted steps be taken by a user to disengage or release a screw from the device which similarly results in reduced efficiency during the manufacturing process.

Still another deficiency common to a few of the prior art screw holding devices of the first design category is the propensity for such assemblies to be heavy and cumbersome when employed in typical commercial, or consumer environments. An example of such a device is disclosed in U.S. Pat. No. 4,936,169. As should be understood, an operator of such a prior art screw holding device would typically utilize this device continually throughout a work shift, or during the course of a common home improvement project. Further, and as a general matter, power fastening tools of this same type are typically utilized during such operations at arm's length away from a user's body, or in some cases, directly above the user's head. Therefore, the weight and cumbersome characteristics of these prior art fastening tools reduces the efficiency of a user by causing fatigue.

Yet another deficiency attendant with the prior art screw holding devices of the first design category is their complexity of design. This is particularly true for the prior art screw holding device which is disclosed in U.S. Pat. No. 4,936,169. This complexity of design, as should be understood, increases the likelihood that such screw holding devices will fail, jam or otherwise malfunction during operation when they are exposed to the dust or debris which is typically generated during their use. Further, and as should be readily apparent, the complex design of these screw holding devices increases the manufacturing costs for same.

Therefore, it has long been known that it would be desireable to have an apparatus for facilitating the installation of screws, and which is particularly well suited to retain a screw in tight engagement with respect to a bit of a screw driving means, and which further is operable to automatically release the screw upon engagement of the apparatus with a work piece or surface, and wherein the apparatus is lightweight, simple in design, and may also be releasably mounted on a variety of portable powered screw driver tools, or similar devices.

OBJECTS AND SUMMARY OF THE INVENTION

Therefore, it is an object of the present invention to provide an improved fastener support apparatus.

Another object of the present invention is to provide such an apparatus which is operable to obtain the individual benefits to be derived from related prior art apparatuses and practices while avoiding the detriments individually associated therewith.

Another object of the present invention is to provide such an apparatus which is operable to facilitate the installation of fasteners into a work piece.

Another object of the present invention is to provide such an apparatus which is lightweight, and maneuverable, and therefore reduces fatigue during the use thereof.

Another object of the present invention is to provide such an apparatus which can be made integral with, or alternatively, readily retrofitted on a variety of different types of powered screw driving means.

Another object of the present invention is to provide such an apparatus which is operable to fixedly position a screw in tight engagement with a bit of a powered screw driving means throughout a substantial portion of the screw installation cycle, but which automatically releases the screw when the apparatus contacts or otherwise engages a work piece or surface.

Another object of the present invention is to provide such an apparatus which reduces, or substantially eliminates, distortion or burring of a screw head.

Another object of the present invention is to provide such an apparatus which is of relatively moderate cost to purchase and maintain, and further is inexpensive to operate.

Another object of the present invention is to provide such an apparatus which is characterized by ease of employment, and simplicity of construction.

Further objects and advantages of the present invention are to provide improved elements and arrangements thereof in an apparatus for the purposes described which is dependable, economical, durable and fully effective in accomplishing its intended purposes.

These and other objects and advantages are achieved in an apparatus for facilitating the installation of individual screws into a work surface, the apparatus having a means for driving the individual screws into the work surface; a support member borne on the drive means and having a proximal end disposed on the drive means, and an opposite distal end; a screw support assembly borne on the distal end of the support member, and which includes a passageway defining a screw receiving station and which is operable to receive the head of a screw; a locking assembly borne on the screw support assembly and operable for travel from a first, partially occluding position relative to the passageway, to a second, substantially nonoccluding position; and an actuating assembly borne by the screw support assembly and which positions the locking assembly in the first, or second positions, and wherein during operation, the locking assembly, when disposed in the first, partially occluding position, retains the head of the screw in the screw receiving station, and when disposed in the second, substantially nonoccluding position, releases the screw from the screw receiving station such that the screw may be driven into the work surface.

DETAILED DESCRIPTION

Figure 1:
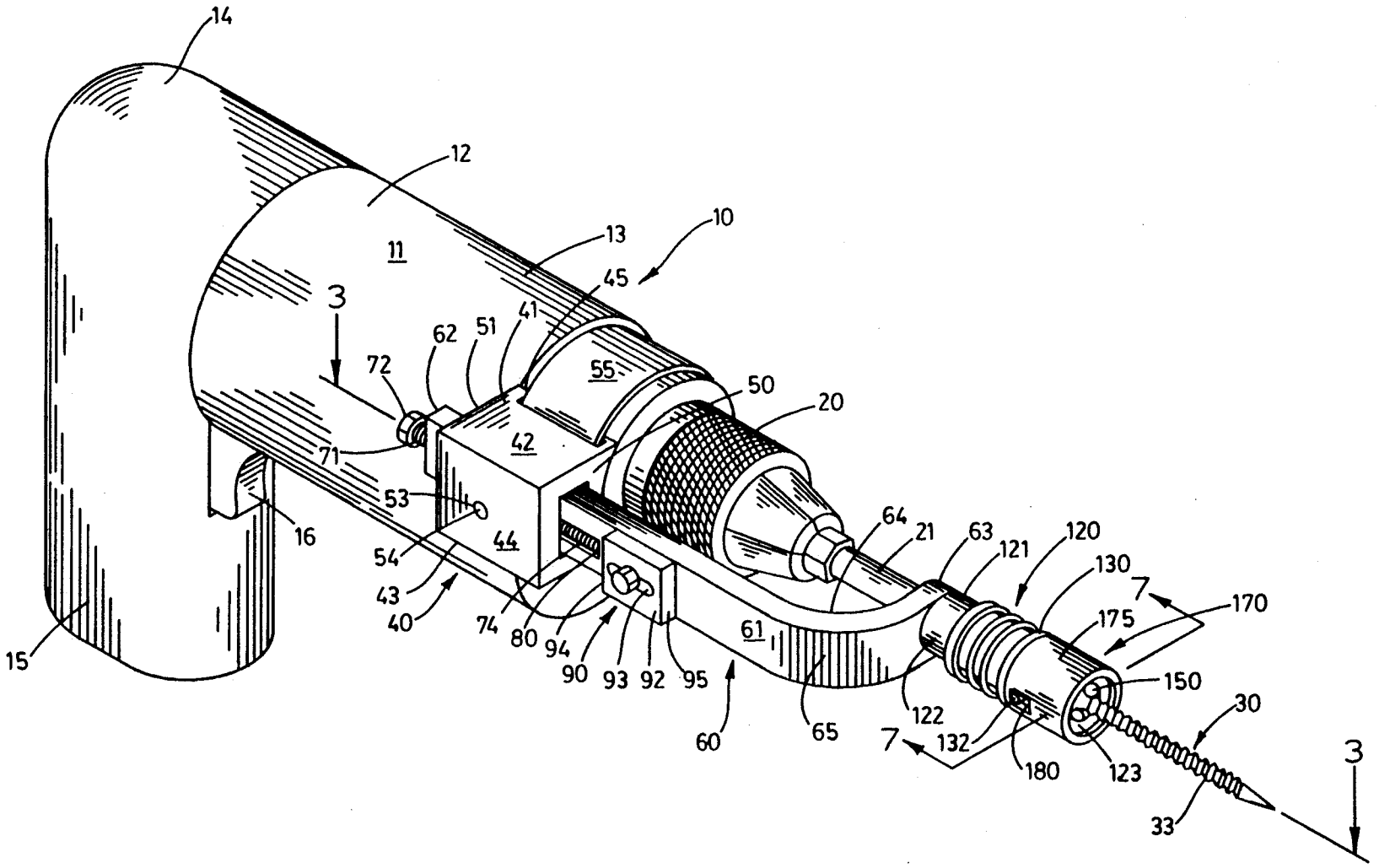
FIG. 1 is a right, perspective, environmental view of the apparatus of the subject invention shown in a typical operative configuration and wherein it is mounted on a portable power drill.
Figure 2:
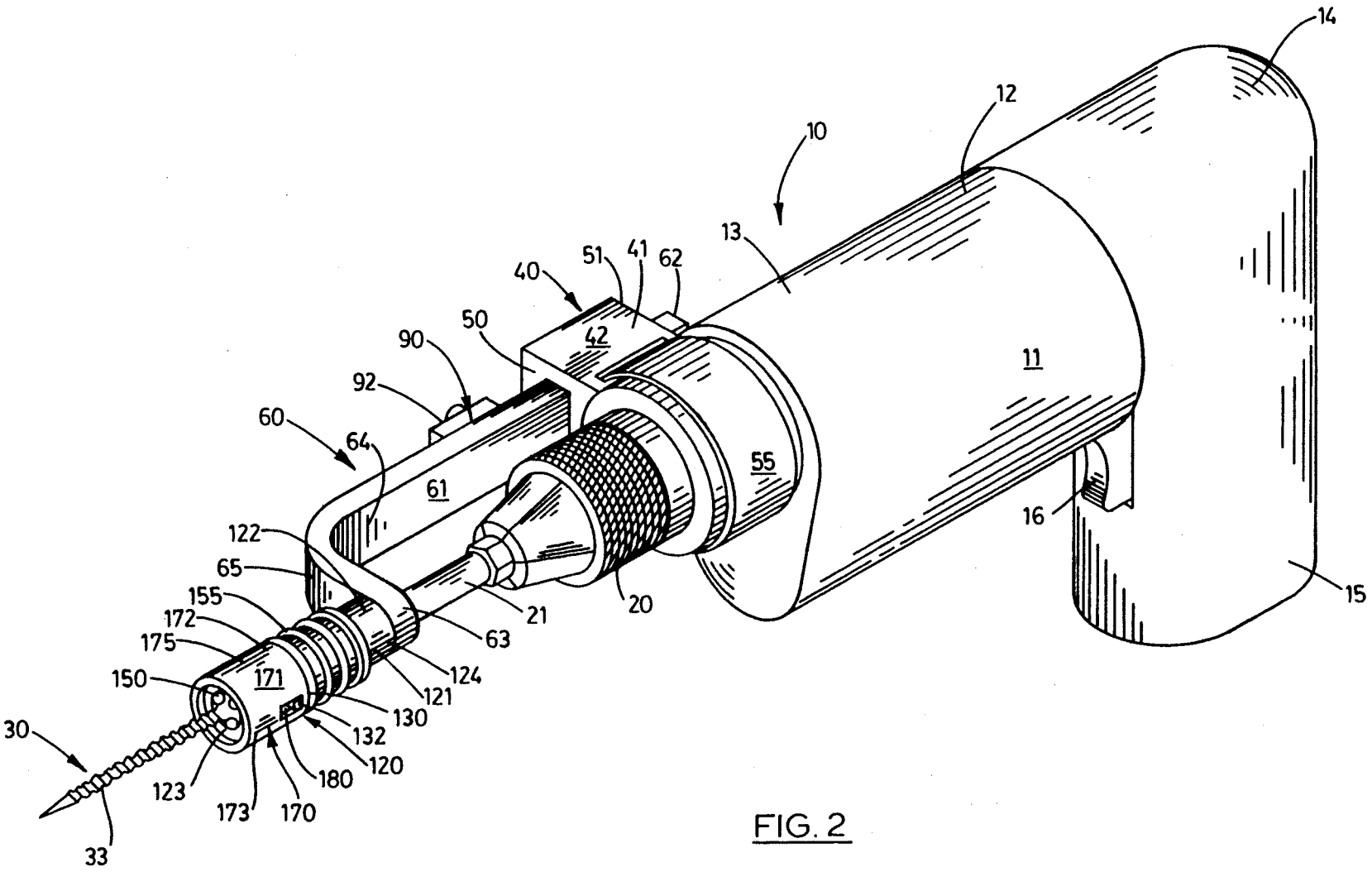
FIG. 2 is a left, perspective, environmental view of the apparatus of the subject invention shown in a typical operative configuration and wherein it is mounted on a portable power drill.

The apparatus of the present invention is generally indicated by the numeral 10 and is best seen in the environmental views of FIGS. 1 and 2, respectively. The apparatus 10 is rendered operable for use in combination with a portable power drill and which is generally indicated by the numeral 11. As should be understood, the drill is of conventional design and may be energized by assorted conventional power sources. The drill has a housing, which is generally indicated by the numeral 12, and which has a forward end 13 and an opposite rearward end 14. Depending downwardly relative to the rearward end of the housing 14 is a handle 15. The handle mounts a moveable trigger or switch 16 which selectively energizes the drill thereby imparting rotational motion to a rotatable chuck 20 by means of a motor, which is not shown. The chuck 20 is also of conventional design and is operable to receive, and fixedly mount for substantially rotatable motion, a bit 21 which is also of conventional design. The rotatable bit has a first end 22 which is designed to engage a head of a suitable screw and which will be discussed in further detail hereinafter. Further, the bit has an opposite, second end 23 and which is received in and otherwise engaged by, the chuck. As best seen by reference to FIG. 3, the second end of the rotatable bit has an exterior surface 24 which defines a plurality of engagement surfaces 25. The second end of the bit has a substantially hexagonal, cross-sectional configuration.

Figure 3:
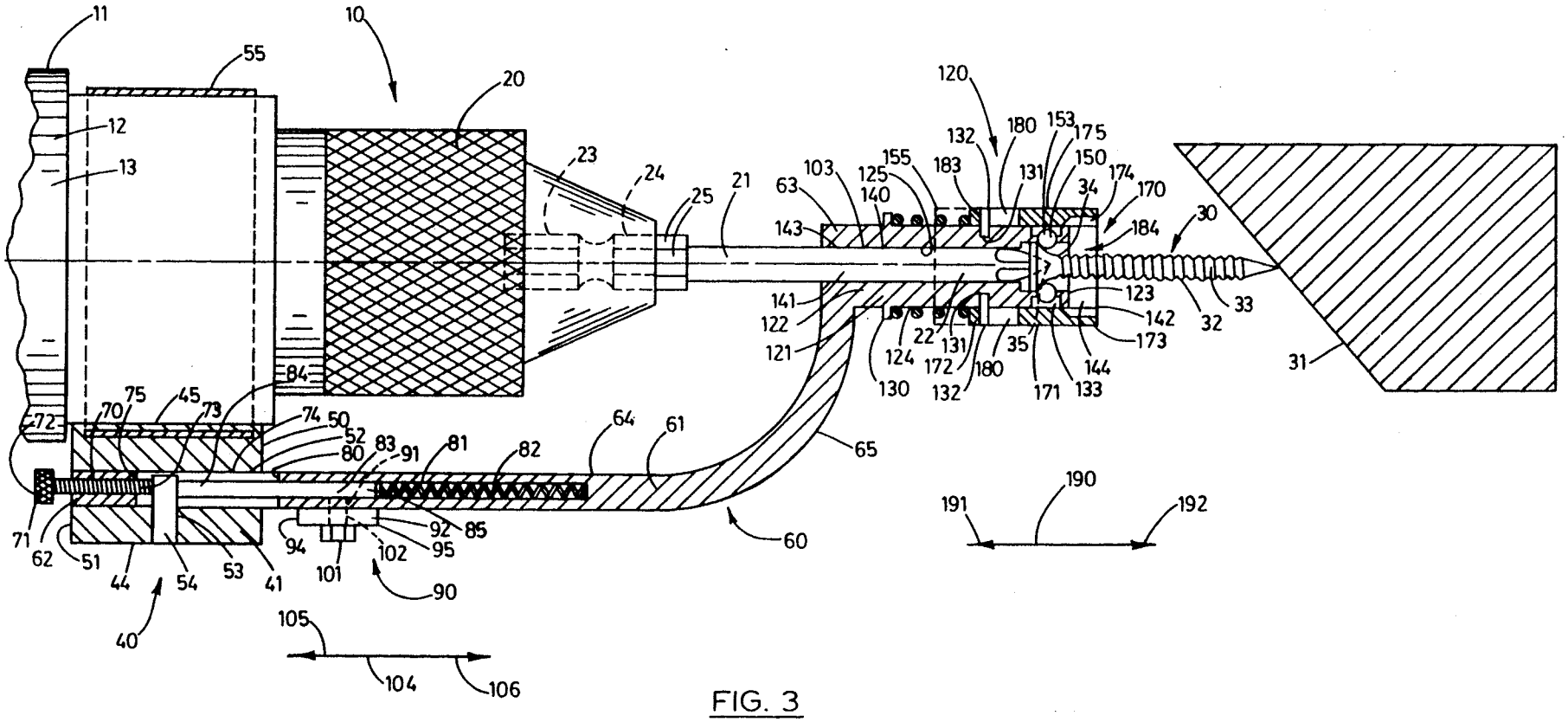
FIG. 3 is a fragmentary, plan, longitudinal sectional view of the apparatus of the subject invention, and which is taken from a position along line 3—3 of FIG. 1.
Figure 4:
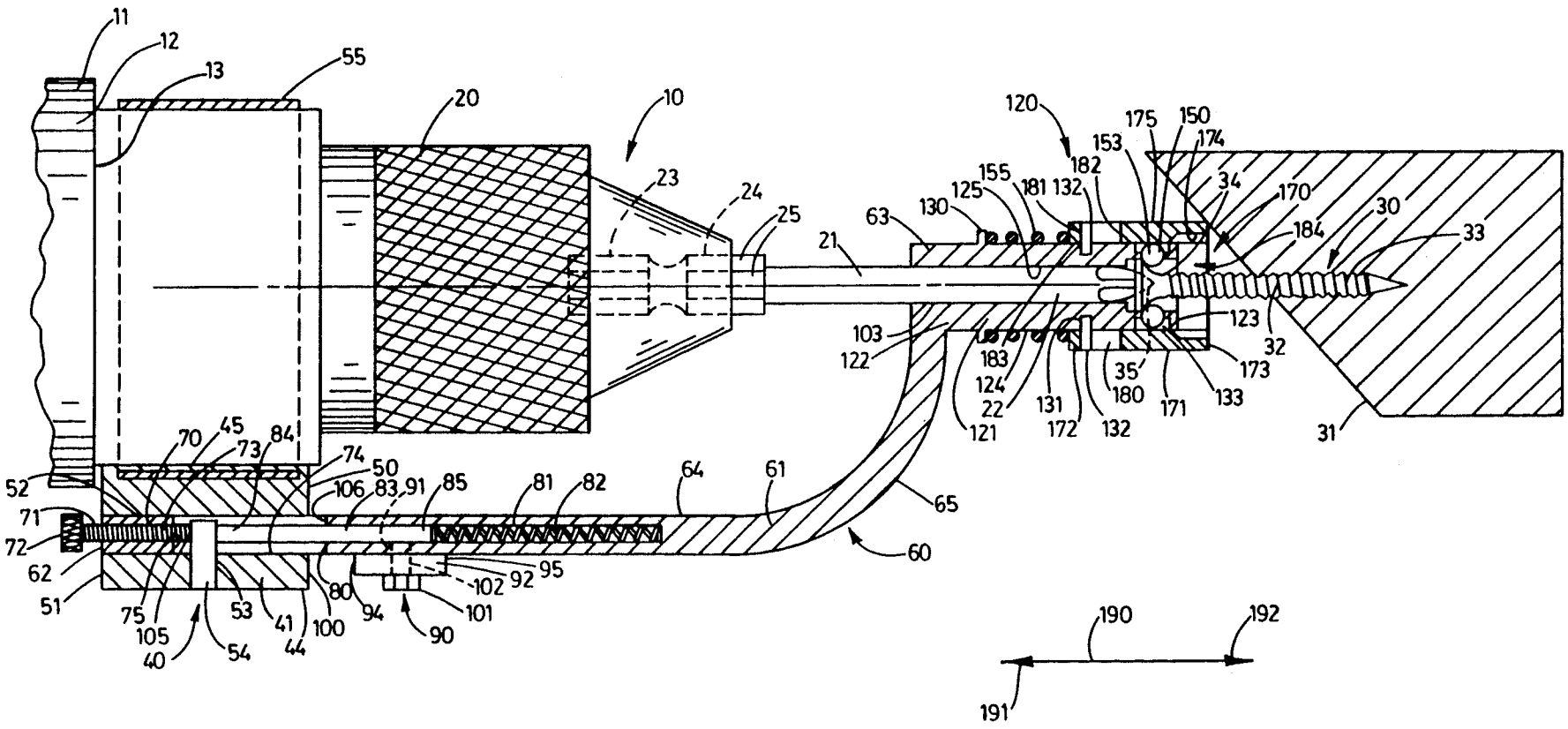
FIG. 4 is a fragmentary, plan, longitudinal sectional view of the apparatus of the subject invention, and which is taken from a position along line 3—3 of FIG. 1.

As best understood by a study of FIGS. 3 and 4, respectively, the apparatus 10 of the subject invention is operable for facilitating the installation of individual screws 30 into a work surface or piece and which is generally indicated by the numeral 31. The screws 30 are of conventional design and have a main body 32 which includes a threaded shaft 33 and which is adapted to threadably engage the work surface 31. Further, the screw has an opposite, screw head 34, which has formed in its surface a slot 35 for receiving the first end 22 of the rotatable bit 21. As best seen by reference to FIG. 6, the apparatus 10 of the subject invention is releasably secured on the forward end 13 of the drill housing 12 by way of a mounting assembly, and which is generally indicated by the numeral 40. The mounting assembly has a main body 41, which has opposite top and bottom surfaces 42 and 43, respectively, and a right lateral surface 44, and a left lateral surface 45, which is substantially arcuately shaped and which is operable to matingly engage, in fitted relation, the housing 12 of the drill 11. Further, the main body 41 has a forward facing surface 50 and an opposite rearward facing surface 51. Formed in the main body and extending substantially longitudinally therethrough, is a substantially rectangularly shaped passageway 52. Further, and as best seen by reference to FIG. 5 and 6, a transversely disposed passageway or bore 53 is formed in the right laterally disposed surface 44 and is disposed in communication with the passageway 52. A post or shaft 54 is received in the passageway 53 and extends into partially occluding relation relative to the passageway 52. This relationship is best seen by references to FIGS. 3 and 4, for example. The operation of the post will be discussed in further detail hereinafter. The main body 41 is releasably secured on the forward end 13 of the housing 12 by way of a strap, and which is generally indicated by the numeral 55. The strap is fastened to the main body by using conventional fastening techniques and further is tightened about the forward end 13 of the housing 12 by employing an adjusting assembly, which is not shown. As should be understood, the mounting assembly is operable to support the apparatus 10 for reciprocal movement along a predetermined path of travel which will be discussed in further detail hereinafter. It should be understood, of course, that the mounting assembly may be made integral with drill 11.

Figure 5:
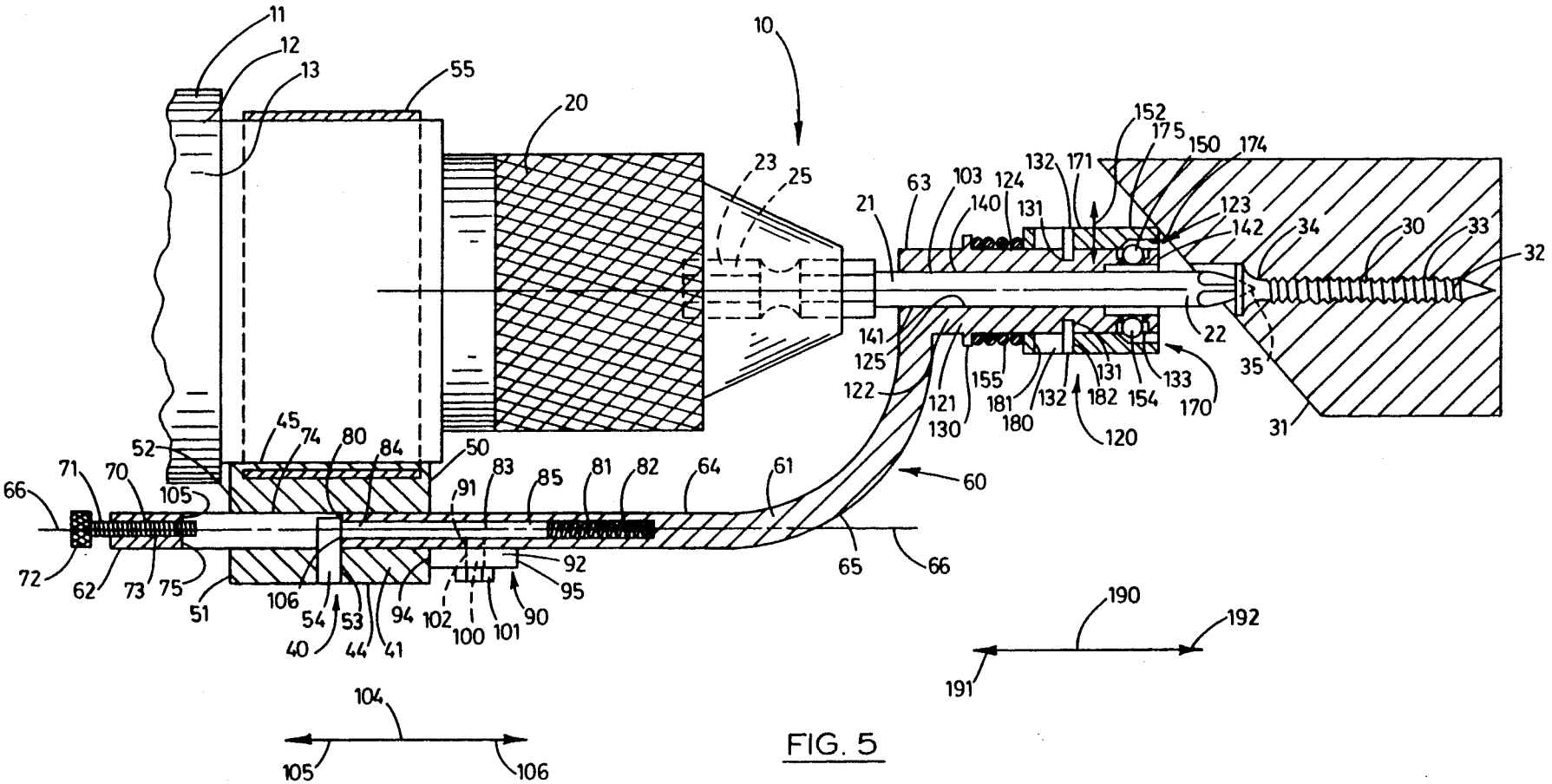
FIG. 5 is a fragmentary, plan, longitudinal sectional view of the apparatus of the subject invention, and which is taken from a position along line 3—3 of FIG. 1.
Figures 6, 7:
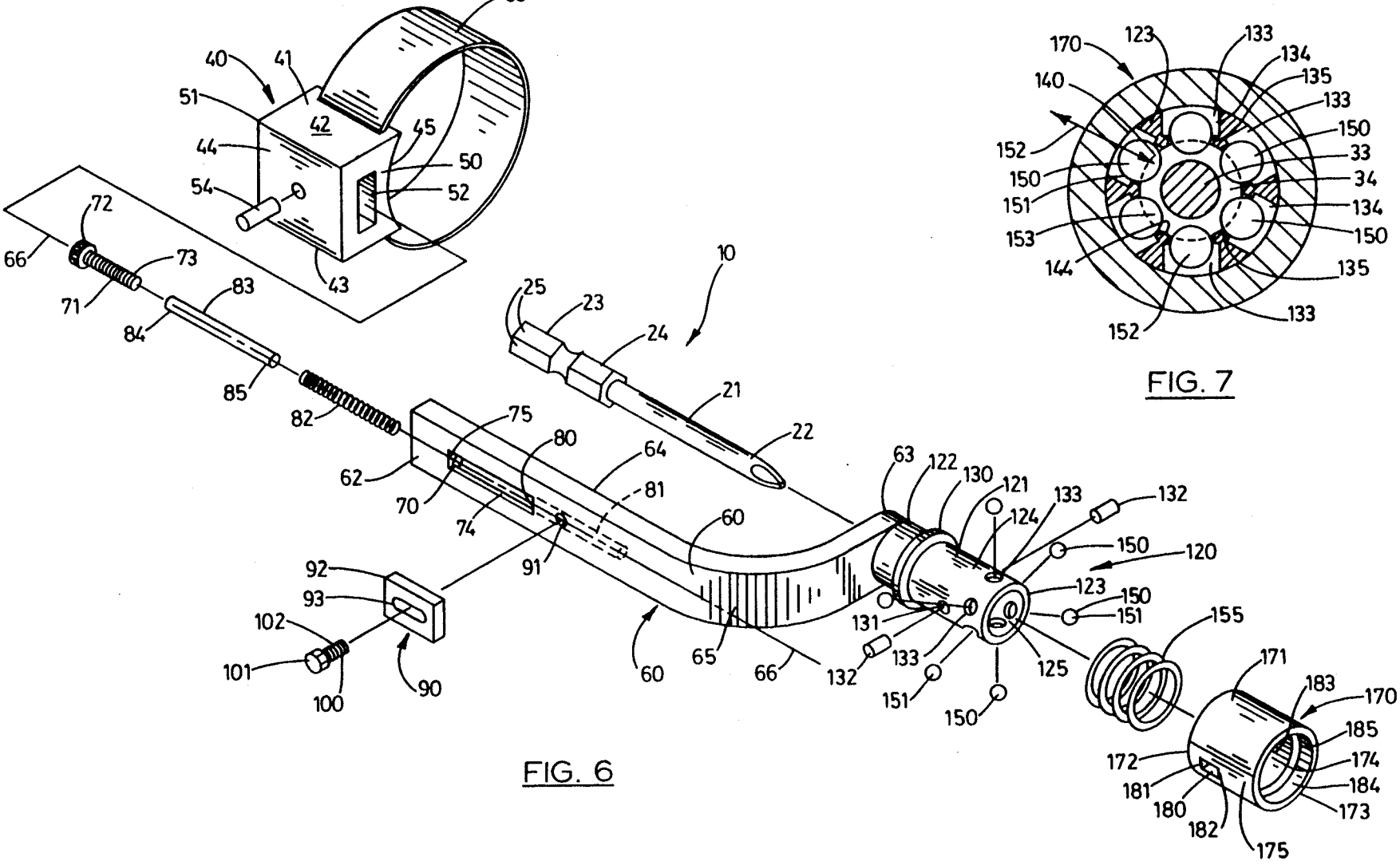
FIG. 6 is a perspective, exploded view of the apparatus of the subject invention shown in FIG. 1.
FIG. 7 is a transverse, vertical, sectional view of the apparatus of the subject invention and taken from a position along line 7—7 of FIG. 1.

As best appreciated by a study of the exploded, perspective view of FIG. 6, the mounting assembly 40 is operable to receive and support for reciprocal motion a support member, and which is generally indicated by the numeral 60. The support member 60 has a main body 61 with a proximal end 62 which is slidably received in the passageway 52, and further, has an opposite distal end 63. Additionally, the main body has an interior facing surface 64 and an opposite exterior facing surface 65. As should be understood, the support member 60 has a longitudinal axis which is generally indicated by the line labeled 66. As best seen by reference to FIG. 5, for example, a threaded bore 70 is formed in the proximal end 62 of the support member and is operable to receive a threaded fastener 71 which operates as an adjustment assembly for the present device. The threaded fastener 71 includes a head 72 which is configured in a fashion such that it may be manipulated by hand. Further, the fastener 71 has an opposite, threaded shaft 73 which is received in the threaded bore 70. The operation of the adjustment assembly of the present device will be discussed in greater detail hereinafter. As best seen by the study of FIGS. 5 and 6, for example, a longitudinally disposed slot 74 is formed in the main body 61 of the support member 60 and extends therethrough. The longitudinally disposed slot has a first end 75, and an opposite second end 80. As best seen by reference to FIG. 5, the threaded bore 70 is disposed in communication with the first end 75 of the longitudinal slot. Further, and extending substantially longitudinally, forwardly, relative to the second end 80 of the longitudinal slot is a plunger passageway, and which is generally indicated by the numeral 81. The plunger passageway is a substantially smooth bore and is operable to receive a biasing spring 82 and which operates as a first biasing assembly for the present device 10. The biasing spring 82 is of substantially conventional design.

A cylindrically shaped plunger 83 is telescopingly or otherwise slidably mounted for reciprocal motion internally of the plunger passageway 81. The plunger has a first, or engagement end 84, and which engages or rests in contact against the post 54, and an opposite, second end 85 and which rests in contact against the biasing spring 82. The operation of the plunger, in combination with the post 54 will be discussed in greater detail hereinafter. As earlier discussed, the mounting assembly 40 is operable to slidably receive the support member 60 and support it for substantially longitudinal and reciprocal motion in the passageway 52. As best seen by reference to FIGS. 5 and 6, for example, this rearward movement of the support member is limited or otherwise defined by a depth adjustment assembly and which is generally indicated by the numeral 90. As best seen by a study of FIGS. 3, 4, and 5, for example, a threaded bore, and which is generally indicated by the numeral 91 is formed in exterior facing surface 65 of the main body 61. The depth adjustment assembly includes a main body 92 which has a substantially longitudinally disposed slot 93 of predetermined dimensions formed therein. The main body 92 further includes a first, engagement end 94, and an opposite, second end 95. Additionally, a threaded fastener 100 is threadably received in the bore 91 and is operable to secure the main body 92 in a predetermined position relative to the main body 61 of the support member 60 such that upon rearward motion of the support member, the main body 92, and more particularly, the engagement end 94 thereof, comes into contact with the forward facing surface 50 of the mounting assembly 40 thereby inhibiting any further rearward motion of the support member 60. As should be understood, and upon reciprocal slidable movement of the support member, the depth block limits the movement of the support member in a fashion which permits the apparatus 10 to countersink a threaded fastener 30 a predetermined distance below the surface of the work object 31. This is best illustrated by reference to FIG. 5, and wherein the first engagement end 94 of the main body 92 is disposed in rested engagement against the main body 41 of the mounting assembly. The operation of the present device will be discussed in further detail hereinafter. As should be understood, the fastener 100 has a head 101 which is dimensioned such that it may be manipulated by hand, and further has a threaded shaft 102 which is threadably received in the threaded bore 91. As best illustrated by reference to FIG. 4 and 5, for example, a substantially longitudinally disposed passageway or aperture 103 is formed in the distal end 63 of the support member 60 and has a predetermined diametral dimension which permits the rotatable bit 21 to be received therein and rotated about its respective axis of rotation. The passageway 103 is substantially coaxially aligned relative to the bit and is further oriented in substantially parallel, spaced relation relative to the longitudinal line of reference 66. The depth adjustment assembly 90 operating in combination with the spring biased plunger 81 renders the support member 60 reciprocally moveable along a longitudinally disposed path of travel 104 from a first position 105, wherein the post 54 rests against the adjustment assembly 71 (FIG. 3), to a second position 106 (FIG. 5), wherein depth adjustment assembly engages the mounting assembly 40 thereby limiting the depth to which the bit 21 can countersink the screw 30 below the surface of the work object 31.

As best understood by a study of FIGS. 5 and 6, for example, the apparatus 10 of the subject invention includes a screw support assembly and which is generally indicated by the numeral 120, and which is further mounted on or made integral with the distal end 63 of the support member 60. As best illustrated by reference to FIG. 6, the screw support assembly has a main body 121, which has a proximal end 122, and a distal end 123. The screw support assembly also has an external facing surface 124, and an internal facing surface 125. Extending generally radially, outwardly, relative to the external facing surface 124 is a substantially circumscribing flange 130. The operation of the flange will be discussed in further detail herein. Further, and formed in predetermined positions in the external facing surface 124 are a pair of bores 131 which extend generally radially inwardly therefrom. Each of the bores 131 are operable to individually receive pins 132 which are held by the effect of friction or by other fastening techniques in same. As best illustrated by reference to FIG. 6, a plurality of apertures 133 are formed in the distal end 123 of the screw support assembly. As best illustrated in FIG. 7, each of the apertures 133 have a first portion 134 which has a predetermined diametral dimension, and a second portion 135 which has a reduced diametral dimension relative thereto. The operation of these apertures will be discussed in further detail herein. As best illustrated by reference to FIG. 5, for example, the internal facing surface 125 defines a longitudinally disposed bore or passageway 140 and which has a first end 141 which is disposed in substantial registry with, or in coaxial alignment relative to the passageway or aperture 103; and an opposite second end 142. As should be noted, the longitudinally disposed bore has a first portion 143, which has a predetermined cross-sectional or diametral dimension, and a second portion 144, which has a substantially greater diametral dimension relative to the first portion. The second portion defines a screw receiving station and which is operable to receive the head 34 of the screw 35. This is best illustrated by reference to FIG. 3 and 4, for example.

As best illustrated in FIG. 6, the apparatus 10 of the subject invention includes a plurality of spherical members, and which may be referred to, from time-to-time hereinafter, as a locking assembly 50. Each of the spherical members has an external facing surface 152, and a predetermined diametral dimension which permits the individual spherical members to be individually received in each of the apertures 133. Each of the spherical members are operable for movement along predetermined, substantially radially disposed paths of travel 152 from a first, retaining position whereby a portion of their respective external surfaces 152 are disposed in partially occluding relation relative to the second portion 144 of the bore 140; to a second, release position 154, and wherein each of the spherical members are positioned in substantially nonoccluding relation relative to the second portion of the bore 144, and are generally positioned in the first portion 134 of the individual apertures 133. This movement of the individual spherical members along their respective paths of travel is best understood by a study of FIGS. 4 and 5, respectively. As best illustrated by reference to FIG. 6, a compression spring, of conventional design, is received about the main body 121 of the screw support assembly 120 and is disposed in rested receipt against the circumscribing flange 130.

An actuating assembly, and which is herein illustrated as a sleeve 170, is slidably, or otherwise telescopingly mounted on the main body 121 of the screw support assembly 120. The sleeve has a main body 171 which has a first end 172, and which is engaged by the compression spring 155; and an opposite second end 173 which is remote thereto. Further, the main body 171 has an internal facing surface 174, and an external facing surface 175. As best seen in FIGS. 5 and 6, for example, a pair of longitudinally disposed slots 180 are formed in predetermined positions in the main body 171, and have a first end 181 and an opposite second end 182 As best seen in FIG. 5, the individual slots are operable to receive the pins 132, the individual pins 132 securing the main body 171 on the sleeve 170 and rendering it slidably moveable over the external facing surface 124 screw support assembly 120. The sleeve 170 and, more particularly, the internal surface 174 thereof, defines a first bore 183, and which has a predetermined diametral dimension; and a second bore 184, and which is disposed in substantially coaxial alignment relative to the first bore, and which has a diametral dimension which is greater than the first bore. As best appreciated by a study of FIG. 5, for example, the first bore 183 has a diametral dimension which is just slightly greater than the outside diametral dimension of the main body 121 of the screw support assembly 120. Further, and as best seen in FIGS. 4 and 5, for example, a generally nonorthogonally disposed surface 185 and is disposed between the first and second bores 183 and 184, respectively.

As should be understood, the sleeve or actuating assembly 170 is operable for movement along a reciprocal path of travel 190 from a first retaining position 191 to a second, release position 192. As should be understood, the sleeve, when disposed in the first retaining position, urges the locking assembly 150, and which has been herein described as a plurality of spherical members, along their respective paths of travel and into their first position, where they are disposed in partially occluding relation relative to the bore 144; and when the sleeve is moved to the second, release position, the spherical members are permitted to travel to the second position 154, thereby releasing the head 34 of the screw 30 from the screw receiving station which is defined by the second portion 144 of the bore 140. As earlier discussed, the individual pins 132 are received in each of the slots 180 and therefore limits or defines the movement of the sleeve from the first to the second positions 191, and 192, respectively. More particularly, and when the individual pins 131 are disposed in contact with the first end 181 of the longitudinally disposed slots 180, the sleeve is disposed in the first, retaining position 191; and when the pins are disposed at the second end 182 of the longitudinally disposed slots, the sleeve is disposed in the second, release position 192. Further, it should be understood that the compression spring is operable to urge the sleeve along the path of travel and towards the first, retaining position. As should be appreciated, and when the sleeve engages the work surface 31 as illustrated by FIG. 5, further movement of the drill 11 towards the work surface causes the sleeve to move rearwardly and along the path of movement 190 from the first position 191 to the second position 192, thereby placing the spring into compression and thus permitting the individual spherical members to move to the substantially nonoccluding position relative to the screw receiving station thus releasing the screw from same so that it may be countersunk a predetermined distance below the surface of the work surface 31.

OPERATION

The operation of the described embodiment of the present invention is believed to be readily apparent and is therefore briefly summarized at this point.

The apparatus 10 of the subject invention and which facilitates the installation of individual screws 30 into an adjoining work surface or object 31 is best illustrated by reference to FIGS. 1 and 6, respectively. As best seen in FIG. 1, the apparatus 10 is releasably mounted on a driving means and which is herein illustrated as a portable drill 11. As earlier discussed, the portable drill mounts a rotatable bit 21 of conventional design and which has a first end 22 which engages the screw head 34 of the individual screws which are being installed. The apparatus 10 further includes a support member 60 and which is borne on the drill 11, and which is supported for reciprocal motion relative thereto by a mounting assembly 40. The mounting assembly is releasably secured on the housing 12. Mounted on or made integral with the distal end 63 of the support member 60 is the screw support assembly and which is generally indicated by the numeral 120. The screw support assembly includes a passageway or longitudinally disposed bore 140, and which defines a screw receiving station 144, and which is operable to receive the head of the screw. In addition to the foregoing, a locking assembly, and which is generally indicated by the numeral 150, includes a plurality of spherical members which are operable to travel from a first or retaining position 153, wherein they are individually disposed in partially occluding relationship relative to the bore or passageway 140, to a second, release position 154, whereby they are disposed in substantially nonoccluding relationship relative to the same bore or passageway. This is best shown by a study of FIGS. 4 and 5, for example. Moreover, and slidably mounted on the screw support assembly 120 is an actuating assembly 170, and which positions the locking assembly in the first or second positions, and wherein during operation, the locking assembly, when disposed in the first position 153, retains the head of the screw in the screw receiving station 144, and when disposed in the second position 154, releases the screw from the screw receiving station such that the screw may be driven into the work surface. In addition to the foregoing, and as earlier discussed, the support member 60 is reciprocally mounted on the drill and further includes a depth adjustment assembly 90 which permits the apparatus to countersink the screw a predetermined distance below the surface of the work object. In this regard, it should be understood that the depth adjustment assembly limits the reciprocal movement of the support member 60 relative to the mounting assembly 40 thereby restraining the movement of the rotatable bit 21 to a predetermined distance beyond the second end 173 of the sleeve when the sleeve is disposed in second position 192 (FIG. 5).

As best illustrated by reference to FIGS. 4 and 5, for example, a fastener support apparatus 10 is shown for facilitating the installation of individual screws 30 into the work surface 31 and wherein the screws include a main body 32 with a first end having a head 34 and an opposite, second end which has a plurality of threads 33 for engaging the work surface. The apparatus 10 includes a driving means which is herein illustrated as a portable drill 11 and wherein the drive means includes a rotatable bit 21 which is operable to impart rotational movement to the screw about its longitudinal axis. A mounting assembly 40 is borne on the drive means 11 and which slidably supports the apparatus for reciprocal movement along a predetermined path of travel 104. Further, the apparatus includes a support member 60 which has a main body 61 with a proximal end 61 and an opposite distal end 63, and wherein the proximal end is slidably borne on the drive means by the mounting assembly 40. The apparatus 10 includes a first biasing assembly 82 and which is borne on the support member, and which is operable to urge the support member along the path of travel 104 and in a direction away from the drive means 11. A screw support assembly 120 is borne on the distal end 63 of the support member 60 and has a main body 121 which includes internal and external facing surfaces 125, and 124, respectively, and wherein the internal facing surface defines a bore 140 which is substantially coaxially aligned relative to the bit 21 and which is operable to receive the head 34 of the screw 30, and wherein the main body further has formed therein at least one aperture 133 which communicates with the bore. A locking assembly 150 and which will include at least one spherical member, is mounted or received in the aperture 133, and is operable for movement along a predetermined path of travel 152 into, and out, of partially occluding relation relative to the bore. As should be understood, the locking assembly retains the head of the screw in a predetermined position within the bore when disposed in the partially occluding position, and releases the screw from the bore when the locking assembly is disposed in the substantially nonoccluding position. A sleeve 170 having a main body 171 and which includes opposite first and second ends 172, and 173, and internal and external facing surfaces 174, and 175, is slidably mounted on the screw support assembly 120. The internal facing surface 174 defines a first bore 183 which has a predetermined cross-sectional dimension and which slidably, and telescopingly receives the main body 121 of the screw support assembly 120. The internal facing surface 174 of the second end 173 defines a second bore 184 having a cross-sectional dimension which is greater than the cross-sectional dimension of the first bore. As earlier discussed, the sleeve is operable for travel from a first retaining position 191, to a second, release position 192. As should be understood, the sleeve, when disposed in the first retaining position, urges the locking assembly into the first, partially occluding position 153 relative to the bore 144, and when the sleeve is moved to the second, release position 192, the locking assembly is permitted to travel to the second, substantially nonoccluding position 154. A second, biasing assembly 155 is borne on the screw support assembly 120 and urges the sleeve toward the first, retaining position 191. Additionally, the apparatus 10 includes an adjustment assembly 71 which is borne on the support member 60 and which is operable to adjustably position the screw head 34 relative to the bit 21 when the screw head is disposed in the screw receiving station 144 thereby ensuring that the bit is held in tight engagement with the screw head. During operation of the apparatus 10, the sleeve 170 is moved manually to the second release position 192, which permits the locking assembly 150 to travel from the first, partially occluding position 153 to the second, nonoccluding position 154, thereby allowing a screw head 34 to be received in the bore 144 of the screw support assembly. Further, and when released, the spring 155 urges the sleeve to the first, retaining position 191 thereby positioning the locking assembly in partially occluding relation relative to the bore and thus retaining the screw head in a predetermined position relative to the bit 21. Additionally, and as best illustrated by reference to FIG. 5, when the sleeve engages a work surface 31, continued forward motion of the drill 11 towards the work surface causes the sleeve to move from the first retaining position, to the second release position, thereby releasing the screw from the screw support assembly.

Therefore, the apparatus 10 of the present invention can be utilized and retrofitted for operation on a wide variety of screw driving means or further can be made integral therewith. In addition, the present invention may be used in all manner of commercial environments to expedite the assembly of various objects of commerce, as well as can be utilized for various home improvement projects and the like. The apparatus can be easily installed, is simple to maintain, and further can be manufactured at a nominal price when compared with other prior art devices which are utilized for substantially similar purposes.

While the invention has been herein shown and described in what is conceived to be the most practical and preferred embodiment, it is to be recognized that departures may be made therefrom within the scope of the invention which is not to be limited to the illustrated details disclosed.

Having described my invention, what I claim as new and desire to secure by Letters Patent of the United States is:

1. A fastener support apparatus for facilitating the installation of individual screws into a work surface, the apparatus comprising:

means for driving the individual screws into the work surface;

a support member borne by the drive means and having a proximal end disposed on the drive means, and an opposite distal end;

a mounting assembly borne by the driving means and slideably supporting the support member for reciprocal movement along a predetermined path of travel;

a screw support assembly borne on the distal end of the support member and which includes a passageway defining a screw receiving station and which is operable to receive the head of a screw;

a locking assembly borne by the screw support assembly and operable for travel from a first, partially occluding position relative to the passageway, to a second, substantial nonoccluding position; and an actuating assembly borne by the screw support assembly and which positions the locking assembly in the first or second positions, and wherein during operation, the locking assembly, when disposed in the first, partially occluding position retains the head of the screw in the screw receiving station, and when disposed in the second, substantial nonoccluding position releases the screw from the screw receiving station such that the screw may be driven into the work surface.

2. A fastener support apparatus, as claimed in claim 1, and wherein the driving means includes a rotatable bit which releasably engages the head of the screw, and which imparts rotational movement to the screw about its respective longitudinal axis.

3. A fastener support apparatus, as claimed in claim 2, and wherein the screw support assembly includes a main body having internal and external facing surfaces, and wherein the internal facing surface defines the passageway, and wherein the passageway is substantially coaxially aligned relative to the bit.

4. A fastener support apparatus, as claimed in claim 3, and wherein a first biasing assembly is borne by the support member, and which urges the support member along the predetermined path of travel and in a direction away from the driving means.

5. A fastener support apparatus, as claimed in claim 4, and wherein an aperture is formed in the wall of the screw support assembly and which communicates with the passageway, and wherein the locking assembly is received in the aperture and is movable between the first position, and the second position.

6. A fastener support apparatus, as claimed in claim 5, and wherein the actuating assembly includes a sleeve having a main body with opposite first and second ends, and internal and external facing surfaces, and wherein the internal facing surface of the first end defines a first bore having a predetermined cross sectional dimension, the first end telescopingly receiving the main body of the screw support assembly, and wherein the internal facing surface of the second end defines a second bore having a cross-sectional dimension greater than the cross-sectional dimension of the first bore, and wherein the sleeve is reciprocally movable from a first position, wherein the sleeve urges the locking assembly into the first, partially occluding position, to a second position, wherein the locking assembly may move to the second, substantially nonoccluding position.

7. A fastener support apparatus, as claimed in claim 6, and wherein a second biasing assembly is borne by the support member, and is operable to urge the sleeve into the first position, and wherein engagement of the sleeve with the work surface compresses the second biasing assembly and urges the sleeve to the second position.

8. A fastener support apparatus, as claimed in claim 7, and wherein the second end of the screw support assembly has formed therein a plurality of apertures.

9. A fastener support apparatus, as claimed in claim 8, and wherein the locking assembly includes a plurality of substantially spherical members corresponding in number with the apertures, and wherein the spherical members are individually movably mounted in each of the respective apertures.

10. A fastener support apparatus for facilitating the installation of individual screws into a work surface, the apparatus comprising:

means for driving the individual screws into the work surface, and wherein the driving means includes a rotatable bit;

a support member slidably borne on the driving means and having a main body with a proximal end, and an opposite distal end;

a mounting assembly borne by the drive means and which slideably supports the support member for reciprocal movement along a predetermined path of travel;

a screw support assembly borne on the distal end of the support member and having a main body which includes internal and external facing surfaces, and wherein the internal facing surface defines a bore which is operable to receive the head of the screw, and which receives the rotatable bit, and wherein the main body further has formed therein an aperture which communicates with the bore;

a locking assembly mounted in the aperture and operable for travel from a first, partially occluding position relative to the bore, to a second substantially nonoccluding position;

a sleeve telescopingly borne on the screw support assembly and operable for travel from a first position, wherein the sleeve urges the locking assembly into the first, partially occluding position, to a second position, wherein the locking assembly is permitted to travel to the second, substantially nonoccluding position; and a biasing assembly borne on the support member and which urges the sleeve toward the first position, and wherein during operation, the sleeve is manually moved to the second position thereby permitting the locking assembly to travel to the second, substantially nonoccluding position and thus allowing a screw head to be received in the bore, and wherein the sleeve, when released, travels to the first position thereby positioning the locking assembly in partially occluding relation relative to the bore and retaining the screw head in a predetermined location relative to the rotatable bit, and wherein engagement of the sleeve with the work surface urges the sleeve from the first to the second position thereby releasing the screw from the screw support assembly.

11. A fastener support apparatus, as claimed in claim 10, and wherein the bore of the screw support assembly is substantially coaxially aligned relative to the bit.

12. A fastener support apparatus, as claimed in claim 11, and which further includes a second biasing assembly which is borne by the support member, and which is operable to urge the support member along the predetermined path of travel and in a direction away from the driving means.

13. A fastener support apparatus, as claimed in claim 12, and wherein the sleeve includes a main body having opposite first and second ends, and internal and external facing surfaces, and wherein the internal facing surface of the first end defines a first bore having a predetermined cross-sectional dimension which telescopingly receives the main body of the screw support assembly, and wherein the internal facing surface of the second end defines a second bore having a cross-sectional dimension greater than the cross-sectional dimension of the first bore.

14. A fastener support apparatus, as claimed in claim 13, and wherein the second end of the screw support assembly has formed therein a plurality of apertures.

15. A fastener support apparatus, as claimed in claim 14, and wherein the locking assembly includes a plurality of spherical members corresponding in number with the apertures, and wherein the plurality of spherical members are each individually movably mounted in the respective apertures.

16. A fastener support apparatus for facilitating the installation of individual screws into a work surface, and wherein the screws include a main body with a first end having a head, and an opposite second end which has a plurality of threads, the apparatus comprising:

means for driving the individual screws into the work surface, and wherein the driving means includes a rotatable bit which is operable to impart rotational movement to the screw about its longitudinal axis;

a mounting assembly borne on the driving means and which slidably supports the apparatus for reciprocal movement along a predetermined path of travel;

a support member having a main body with a proximal end and an opposite distal end, the proximal end being slidably borne on the mounting assembly;

a first biasing assembly borne on the support member and operable to urge the support member along the path of travel, and in a direction away from the driving means;

a screw support assembly borne on the distal end of the support member and having a main body which includes internal and external facing surfaces, and wherein the internal facing surface defines a bore which is substantially coaxially aligned relative to the bit, and which is operable to receive the head of the screw and the rotatable bit, and wherein the main body further has formed therein an aperture which communicates with the bore;

a locking assembly mounted in the aperture and operable for movement along a predetermined path of travel into, and out of, partially occluding relation relative to the bore, the locking assembly retaining the head of the screw in a predetermined position within the bore when disposed in the partially occluding position, and releasing the screw from the bore when the locking assembly is disposed in the substantially nonoccluding position;

a sleeve having a main body which includes opposite first and second ends, and internal and external facing surfaces, and wherein the internal facing surface of the first end defines a first bore having a predetermined cross-sectional dimension, and which telescopingly receives the main body of the screw support assembly, and wherein the internal facing surface of the second end defines a second bore having a cross-sectional dimension greater than the cross-sectional dimension of the first bore, the sleeve being operable for travel from a first, retaining position, to a second, release position, and wherein the sleeve, when disposed in the first retaining position, urges the locking assembly into the partially occluding position relative to the bore, and when the sleeve is moved to the second release position, the locking assembly is permitted to travel to the substantially nonoccluding position;

a second biasing assembly borne on the screw support assembly and which urges the sleeve into the first, retaining position; and an adjustment assembly borne on the support member and operable to adjustably position the screw head relative to the bit, and wherein, during operation, the sleeve is manually moved to the second, release position which permits the locking assembly to travel to the substantially nonoccluding position thereby allowing a screw head to be received in the bore of the screw support assembly, and wherein the sleeve, when released, travels to the first, retaining position thereby positioning the locking assembly in partially occluding relation relative to the bore and retaining the screw head in a predetermined position relative to the bit, and wherein engagement of the sleeve with the work surface urges the sleeve from the first, retaining position, to the second, release position thereby releasing the screw from the screw support assembly.

* * * * *